United States Patent [19]

Jungmann et al.

[11] Patent Number: 4,840,753

[45] Date of Patent: Jun. 20, 1989

[54] DEVICE FOR AERATING FLUIDS, IN PARTICULAR DURING FLOTATION

[75] Inventors: Andreas Jungmann, Essen; Ulrich Reilard, Dorsten, both of Fed. Rep. of Germany

[73] Assignee: Allmineral Aufbereitungstechnik GmbH & Co. KG, Duisburg, Fed. Rep. of Germany

[21] Appl. No.: 238,352

[22] PCT Filed: Nov. 4, 1987

[86] PCT No.: PCT/EP87/00665

§ 371 Date: Jul. 21, 1988

§ 102(e) Date: Jul. 21, 1988

[87] PCT Pub. No.: WO88/03838

PCT Pub. Date: Jun. 2, 1988

[30] Foreign Application Priority Data

Nov. 26, 1986 [DE] Fed. Rep. of Germany ..... 3640315

[51] Int. Cl.[4] ..... B01F 3/04

[52] U.S. Cl. ..... 261/76; 261/DIG. 75; 209/170

[58] Field of Search ..... 261/DIG. 75, 76; 209/170

[56] References Cited

U.S. PATENT DOCUMENTS

| | | | |
|---|---|---|---|
| 1,810,131 | 6/1931 | Daily | 261/DIG. 75 |
| 1,839,952 | 1/1932 | Daily | 261/DIG. 75 |
| 2,938,629 | 5/1960 | Hollingsworth et al. | 209/170 |
| 4,014,961 | 3/1977 | Popov | 261/DIG. 75 |
| 4,533,123 | 8/1985 | O'Leary | 261/DIG. 75 |
| 4,708,829 | 11/1987 | Bylehn et al. | 209/170 |
| 4,721,562 | 1/1988 | Bamscheidt et al. | 261/76 |
| 4,749,527 | 6/1988 | Rasmusen | 261/76 |

FOREIGN PATENT DOCUMENTS

| | | | |
|---|---|---|---|
| 329012 | 4/1976 | Austria . | |
| 3412431 | 10/1985 | Fed. Rep. of Germany . | |
| 3419153 | 11/1985 | Fed. Rep. of Germany . | |
| 731829 | 9/1932 | France . | |
| 2539772 | 7/1984 | France | 261/DIG. 75 |

*Primary Examiner*—Tim Miles

*Attorney, Agent, or Firm*—Becker & Becker, Inc.

[57] ABSTRACT

Ring injectors for aerating fluids, useful for example in flotation systems, have a housing with a mixing section, in which air is added to the through-flowing fluid through an annular slot. A core is arranged in the center of the mixing section. An air-solid mix is formed in the mixing section by deposition of air bubbles on solid particles. An annular injector with a slot width ($Q_2$) that leads into the airing chamber with a minimum opacifying speed of 2.0 m/s at the inlet of the aerating chamber, has an annex mixing and dispersing section (6) with a cross-section that remains the same until the end (12), as well as a middle piece (10) centrally arranged therein also having a constant cross-section, the length of the mixing and dispersing section (6) being 20 times the width of the annular slot ($Q_3$). The distributing cone (2) and the middle piece (10) can be screwed together or inserted into each other. The air slot can be regulated by spacing rings (13). Screw-shaped strips (8) within the mixing and dispersing section (6) can generate therein a whirl. The aerating device has been tested for the flotation of mineral coal sludges.

13 Claims, 1 Drawing Sheet

DEVICE FOR AERATING FLUIDS, IN PARTICULAR DURING FLOTATION

BACKGROUND OF THE INVENTION

The present invention relates to a device for aerating liquids or fluids, especially during flotation, and is embodied as a ring injector, in the housing of which, through which the fluid flows, there is disposed a middle piece that forms an annular channel with the housing, whereby at the level of the air discharge openings in the wall of the housing, the annular channel has its narrowest cross-sectional area; following this narrowest location of the annular channel in the direction of flow of the fluid, the annular channel undergoes a sudden increase in cross-sectional area, adjoining which a mixing and dispersing section leads to the outlet of the housing.

Devices of this type are known, and are used, for example, during flotation in order to separate the solid materials contained in a slurry from one another. The difficult-to-moisten solid particles are deposited on air bubbles that are generated in such devices, which are also known as gasifiers, injectors, or reactors. The solid material deposited on the air bubbles is generally discharged over the edge of the separating or flotation vessel.

With all aerating devices of this type it is desirable to keep the size of the air bubbles as small as possible, because this facilitates the deposition of solid particles during the flotation.

A device for mixing gases and liquids was already disclosed 50 years ago in U.S. Pat. No. 1,810,131. This device shows features of an aerating device such as was later disclosed (DE-OS No. 34 12 431) as a device for aerating dispersions, especially as a flotation device for delivering fibrous material suspensions or dispersions with a ring injector.

Air is supplied to the ring injector via air supply passages in the mixing section. As a result, the annular gap formed in the ring injector is aerated on the inside and the outside. The mixing section and the middle piece, which is centrally disposed within the mixing and dispersing section, are stepped, as a result of which, similar to a water-jet pump, the air is drawn into the inner and outer regions of the dispersion stream that is formed.

It is an object of the present invention to substantially improve devices of the aforementioned general type so that the specific energy consumption is reduced and the degree of selectively is increased.

This device should be especially suitable for the flotation of coal and other preparation material.

SUMMARY OF THE INVENTION

To realize this object, it is proposed pursuant to the present invention that the aerating device of the aforementioned general type have, as the slurry enters the aeration chamber, a gap width that leads to a minimum slurry speed $V_1$ of 2.0 m/s. The middle piece of the device extends to the outlet of the housing and the diameter remains constant. The annular channel has the same cross-sectional area from the sudden increase to the outlet of the housing, and the length of the mixing and dispersion section is more than 20 times the annular gap width of the annular channel.

Due to the uniform speed in the annular channel resulting from the constant cross-sectional area, the thorough mixing of air bubbles and solid material particles during the course of the mixing section is particularly favorable, since during the course of the entire mixing section the specific energy input is constant.

Tests in a coal-flotation plant have shown that at a slurry speed of greater than 2 m/s, especially at 2.0 to 4.0 m/s, the yield is optimum.

Further structural details will be described in detail subsequently.

The splitting of the core or essential portion of the aerating device into the distributing cone and the middle piece, which can be screwed together or inserted into one another, makes it possible to combine different distributing cones and middle pieces. Depending upon the requirements, it is possible to use distributing cones having different diameters of the base of the straight circular cone, and/or cones having different angles between the base and the side lines of the circular cone, i.e. with increased or decreased slope. By changing the base diameter of the distributing cone, the cross-sectional area of the annular channel is varied at the level of the air discharge openings. The slurry distribution can be influenced by the angle of inclination of the cone.

The strips disposed on the middle piece and/or in the upper part of the housing serve to center the middle piece within the mixing and dispersion section. Such strips can also have a helical shape, and it has been shown that in so doing a swirl flow overlaps the axial flow of the slurry-air-mixture; this swirl flow has an advantageous effect upon the deposition of the solid particles on the air bubbles.

This is also true for the embodiment of a helically grooved or slotted middle piece and/or a similarly grooved or slotted inner wall of the upper part of the housing. In this case, centering of the middle piece can be effected, for example, by centering pins that hold the middle piece in the upper part of the housing.

TABLE 1

| | Test conditions and results with different ring injectors | | | | | | | |
|---|---|---|---|---|---|---|---|---|
| | Gap width $Q_2$ (mm) | Length $L_1$ of the mixing section (mm) | Ratio $L_1/Q_2$ | Slurry speed $v_1$ (m/s) | Retention time in the mixing section 6 (s) | Delivery ash content (a %) | Material yield in the concentrate (m %) | Ash content in the concentrate (a %) |
| Type 1 | 6 | 125 | 20.8 | 9.1 | $7.3 \cdot 10^{-2}$ | 21.4 | 55.5 | 7.4 |
| Type 2 | 3 | 125 | 41.7 | 24.5 | $5.1 \cdot 10^{-3}$ | 22.5 | 64.6 | 7.5 |
| Type 3 | 5 | 600 | 120.0 | 14.8 | $4.1 \cdot 10^{-2}$ | 20.4 | 70.9 | 4.9 |

Table 1 shows the test conditions and test results that were achieved with inventive ring injectors of the Types 1 to 3. During the flotation tests, at half of a commercial scale, a flotation slurry from a mineral coal wash was used as the feed material.

BRIEF DESCRIPTION OF THE DRAWING

One exemplary embodiment of the inventive aerating device is described in detail with the aid of the schematic drawing.

DESCRIPTION OF PREFERRED EMBODIMENTS

Figure 1:
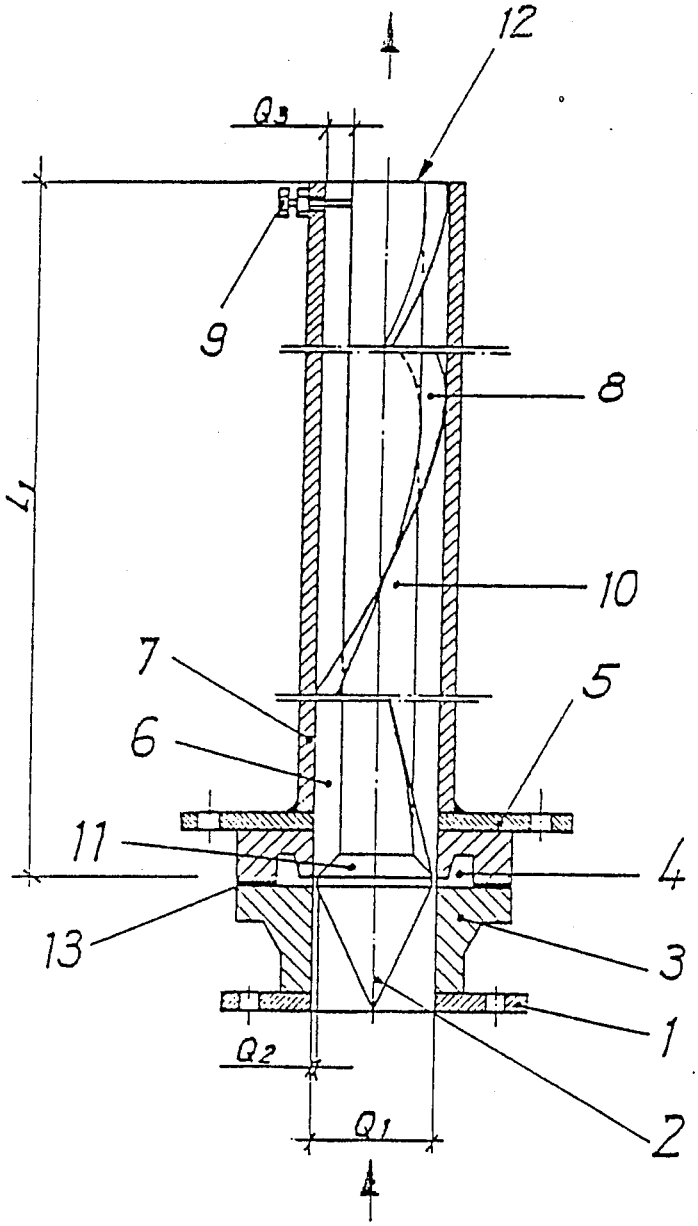

The cross-sectional view of the illustrated aerating device comprises a multi-part housing. The lower part (3) of the housing is provided with the connection flange (1) to which the (not illustrated) slurry line is connected. The arrow indicates the direction of flow of the slurry. The inlet diameter of the aerating device is designated by ($Q_1$).

Connected to the lower part (3) of the housing is a housing section in which is disposed the air chamber (4) with the annular air discharge opening. The aerating medium flows to the air chamber (4) via a (not illustrated) air line.

By inserting spacer rings (13), the gap width of the air discharge openings in the annular gap of the air chamber (4) can be varied.

Disposed above the lower part (3) of the housing with the air chamber (4) is the upper part (7) of the housing. The flange (5) serves for the securement of the aerating device within a line to the (not illustrated) separating vessel or, where the aerating device is disposed externally of the separating vessel, as a line connection on the separating vessel.

Disposed within the housing of the aerating device is the core or essential portion, which comprises a distributing cone (2) and the middle piece (10). The distributing cone and middle piece can be screwed together or inserted into each other. The separating location is at the transition of the reduction of the cross-sectional area of the distributing cone to the middle piece of uniform diameter. The middle piece (10) has a diameter that is uniform over its entire length to the outlet (12) of the housing.

Disposed at the level of the air outlet from the air chamber (4) is the narrowest location of the annular channel for the through flow of the slurry. This narrowest location ($Q_2$) is formed by the largest diameter of the distributing cone (2). The abrupt increase (11) in the cross-sectional area of the annular channel between the distributing cone and the inner wall of the upper part of the housing, which increase in the cross-sectional area results from the structural configuration of the upper portion of the distributing cone (2), prevents, despite the fact that air is received from the air chamber, an increase in the speed in the flotation slurry.

Adjoining the narrowest location of the annular channel is the mixing and dispersing section (6), which has a length $L_1$ and a uniform gap width ($Q_3$) until the outlet (12) of the housing.

Indicated on the middle piece (10) is a helically disposed strip (8) that is intended for centering the middle piece in the upper part (7) of the housing and for generating a swirl flow of the slurry-air-mixture.

A holding mechanism (9) in the form of an adjustable pin is disposed on the upper part (7) of the housing below the outlet (12) of the housing.

The present invention is, of course, in no way restricted to the specific disclosure of the specification, Table 1, and drawing, but also encompasses any modifications within the scope of the appended claims.

What we claim is:

1. A device for aerating fluids and embodied as a ring injector comprising:
   - a housing through which said fluid, in the form of a slurry, flows, with said housing having an inlet end, an outlet end, and air discharge opening means; and
   - a middle piece disposed in said housing in such a way that an annular channel is formed between said middle piece and said housing, with said middle piece having an end that is remote from said outlet end of said housing and that is embodied in such a way that at this location, where said annular channel communicates with said air discharge opening means of said housing, said annular channel increased suddenly, in the direction of flow of said slurry, from its narrowest gap width, which leads to a minimum slurry speed of 2.0 m/s, to a uniform cross-sectional area having a wide gap width that remains constant to said outlet end of said housing and that provides a mixing and dispersing section, the length of which is more than twenty times said constant wider gap width.

2. A device according to claim 1, in which said remote end of said middle piece, where said annular channel increases suddenly, is formed by a separate piece in the form of a distributing cone, with said middle piece and distributing cone being connected to one another and forming the core of said aerating device.

3. A device according to claim 2, in which said middle piece and said distributing cone are connected by being screwed together.

4. A device according to claim 2, in which said middle piece and said distributing cone are connected by being inserted into one another.

5. A device according to claim 2, which includes means for varying the size of said air discharge opening means of said housing.

6. A device according to claim 5, in which said housing includes a lower part that is provided with said inlet end, an upper part that is provided with said outlet end, and between said lower and upper parts a section that is provided with said air discharge opening means and an air chamber that is connected to a supply of air and communicates with said air discharge opening means.

7. A device according to claim 6, in which said means for varying the size of said air discharge opening means is in the form of spacer rings that are adapted to be disposed between said lower part of said housing and said housing section that is provided with said air chamber.

8. A device according to claim 6, which includes at least one strip means that is uniformly disposed in said mixing and dispersing section and extends from where said annular channel increases suddenly to said outlet end of said upper part of said housing.

9. A device according to claim 8, in which said strip means is uniformly disposed on the periphery of said middle piece.

10. A device according to claim 8, in which said strip means is uniformly disposed on an inner periphery of said upper part of said housing.

11. A device according to claim 8, in which said strip means is uniformly disposed on both the periphery of said middle piece and an inner periphery of said upper part of said housing.

12. A device according to claim 8, in which said strip means has a helical configuration with at least one screw thread.

13. A device according to claim 6, in which at least one of said middle piece and an inner wall of said upper part of said housing is provided with helical groove means.

* * * * *